US011375308B2

(12) United States Patent
Kreuzer et al.

(10) Patent No.: US 11,375,308 B2
(45) Date of Patent: Jun. 28, 2022

(54) HOLDING DEVICE

(71) Applicant: Cosinuss GmbH, Munich (DE)

(72) Inventors: Johannes Kreuzer, Munich (DE); Leo Lorenz, Taufkirchen Vils (DE); Tim Adams, Puchheim (DE)

(73) Assignee: Cosinuss GmbH, Munich (DE)

( * ) Notice: Subject to any disclaimer, the term of this patent is extended or adjusted under 35 U.S.C. 154(b) by 0 days.

(21) Appl. No.: 15/733,602

(22) PCT Filed: Mar. 12, 2019

(86) PCT No.: PCT/EP2019/056191
§ 371 (c)(1),
(2) Date: Sep. 11, 2020

(87) PCT Pub. No.: WO2019/175194
PCT Pub. Date: Sep. 19, 2019

(65) Prior Publication Data

US 2020/0413178 A1 Dec. 31, 2020

(30) Foreign Application Priority Data

Mar. 12, 2018 (DE) ..... 10 2018 001 935.8

(51) Int. Cl.
*H04R 25/00* (2006.01)
*H04R 1/10* (2006.01)

(52) U.S. Cl.
CPC ..... *H04R 1/105* (2013.01); *H04R 1/1066* (2013.01)

(58) Field of Classification Search
CPC .... H04R 1/1016; H04R 5/033; H04R 1/1091; H04R 1/105; H04R 2201/107; H04R 1/1083; H04R 25/652; H04R 25/02; H04R 2460/17
See application file for complete search history.

(56) References Cited

U.S. PATENT DOCUMENTS 2,545,731 A * 3/1951 French ..... H04R 25/604 381/381

FOREIGN PATENT DOCUMENTS

EP 1003349 A2 5/2000
WO 2009/147370 A1 12/2009

* cited by examiner

*Primary Examiner* — Amir H Etesam
(74) *Attorney, Agent, or Firm* — Altman & Martin; Steven K Martin

(57) ABSTRACT

The present invention discloses a holding device for attachment to the ear of a user, wherein a flexible connecting element arranged between an end piece and a terminal holder ensures that, even when subjected to relatively pronounced loads caused by external effects, such as for example a change in position of the head, the holding device is securely held on the ear without exerting unpleasant pressure on individual anatomical structures of the ear. By virtue of a flexible basic structure, the holding device according to the invention enables use on both ears of a user, without the holding device having to be adapted individually to each ear by a change in structure. In addition, a box suitable for storing the holding device ensures safe storage of the holding device when not in use, serves to keep the holding device ready for immediate use, and prevents deformation of the holding device caused by improper storage.

16 Claims, 4 Drawing Sheets

HOLDING DEVICE

TECHNICAL FIELD

The invention relates to a holding device for attachment to the ear of a user, according to claim 1, and to a box for holding the holding device, according to claim 14.

PRIOR ART

Holding device for attachment to the ear of a user are known from the prior art. Holding devices for wearing behind the ear or in the ear are known in particular from the technical field of hearing aids. Holding devices can also be detachably attached to anatomically suitable structures of the auricle, for example by way of a spring clip connection.

Holding devices to be worn behind the ear are disadvantageously characterized by a limited stability on the ear, particularly in the event of changes in position of the head of the user, as occur for example during sports activities. US 2012/0124349 discloses a curved element for an earphone, which is to be worn over the ear and is said to provide improved grip during sports activities. The curved element consists of a rear segment, a support hook, a front segment, and a curved transition segment, wherein the earphone in question can be clamped into a clip on the front segment. US 2008/0264429 discloses a protection device for the human ear. The device has an arm, which extends over the auricle, and a closure means ("plug element"), which closes or covers the auditory canal. The device is biased to press against the closure means with the necessary force so that the latter remains in position during use. The shoulder of the device, which extends behind the auricle, acts as the spring in this case, which is in a tensioned state during use. The device disclosed in US 2014/0050343, which is to be worn behind the ear, is designed with an additional bracing element which is braced in the auricle at the lower part of the Concha behind the Antitragus and exerts on an earplug a force that is directed toward the auditory canal.

To avoid any shift in position of the holding device under pronounced acceleration loads, the holding devices known from the prior art must disadvantageously be adapted individually to the respective ear (right, left) of the user. Furthermore, spring elements which prevent slippage of the holding device may exert a pressure that is unpleasant for the user, due to the spring load on the respective ear or relevant parts thereof. Particularly in children, therefore, spring-loaded holding devices are used only to a limited extent.

Presentation of the Invention, Problem, Solution, Advantages

Proceeding from the prior art devices mentioned above, the problem addressed by the present invention is therefore that of providing a holding device which does not have the aforementioned disadvantages.

The holding device according to the invention, which is to be worn behind the ear, is intended to be gently attached to the ear of a user, wherein a flexible connecting element arranged between an end piece and a terminal holder is intended to ensure that, even in the event of relatively pronounced acceleration loads or a change in position of the head, the holding device is securely held on the ear without exerting unpleasant pressure on individual anatomical structures of the ear. The holding device is intended to enable comfortable wearing over a relatively long period of time, for example overnight, and to ensure that the pressure on the auricle caused by parts of the holding device bearing against it is kept as low as possible even when additional pressure is acting from outside on the relevant ear that has the holding device (for example when lying on a support). By virtue of a flexible basic structure, the holding device according to the invention is intended to enable use on both ears of a user, without the holding device having to be adapted to each ear individually by a change in structure. In addition, a box suitable for storing the holding device is intended to ensure safe storage of the holding device when not in use and to ensure that it is ready for immediate use, and also to prevent deformation of the holding device caused by improper storage.

The problem addressed by the invention is solved by the devices defined in the claims, as can also be seen from the accompanying exemplary embodiments.

In a first aspect, therefore, the invention relates to a holding device (1) for attachment to the ear of a user. The holding device (1) comprises an end piece (2), which is designed with a housing (22) to be worn behind an ear of a user, and a terminally arranged holder (3). A substantially S-shaped, flexible connecting element (4) is arranged between the end piece (2) and the holder (3), said connecting element comprising a support hook (41) adjacent to the end piece (2), a middle piece (42), a first transition segment (43), and a second transition segment (44) adjacent to the holder (3). The first transition segment (43) is arranged between the support hook (41) and the middle piece (42), and the second transition segment (44) is arranged between the middle piece (4) and the holder (3). The holding device is designed with an interior space (6) for accommodating various components (5), for example electronic, micromechanical or optical components, wherein the holding device (1) is largely tubular in the region of the connecting element (4). The interior space (6) may be omitted in the terminal part of the end piece (2), thereby simplifying manufacture of the holding device (1) according to the invention. The holding device (1) is characterized in that the connecting element (4) forms a first circular arc (KB1) in the region of the support hook (41) and the first transition segment (43), and forms a second circular arc (KB2) in the region of the second transition segment (44), wherein the first circular arc (KB1) of radius r1 bounds a first circular sector (KS1) and the second circular arc (KB2) of radius r2 bounds a second circular sector (KS2). The ratio between r1 and r2 is such that $r1 \geq r2$.

According to the invention, a circular arc will be understood to mean a continuous part of a circle (of the circular line). In the case of a substantially S-shaped structure, two incomplete circles comprising corresponding circular lines are present, namely a first circular line, formed by a portion of the support hook (41) and the first transition segment (43), and a second circular line, formed by the second transition segment (44). According to the invention, a circular sector denotes the part of the area of a circle that is bounded by a circular arc and two circle radii. A person skilled in the art knows that, in order to determine the radii for a given circular line by means of the respective perpendicular bisector of two chords of the circle, the center of the circle can be determined geometrically. Advantageously, the connecting element (4) with the support hook (41), the first transition segment (43), the middle piece (42), the second transition segment (44) and the terminal holder (3) form a largely S-shaped or gooseneck-shaped structure. The flexible S-shaped connecting element ensures optimal bracing of the holding device in particular anatomical structures both on the medial side and especially on the lateral side of the outer ear. Here, the term "medial" means "oriented toward the center of the body", and the opposite term "lateral" accordingly means "oriented away from the center of the body". When worn, the holding device according to the invention firstly ensures grip on the medial side of the ear due to the close spatial relationship of the support hook (41) and first transition segment (43) and the fossa anthelicis. This anatomical structure is the depression arranged between the temporal region of the head and the auricle. A further bracing of the holding device takes place by means of the second transition segment (44) on the lateral side of the ear in the Concha along the Anthelix. The anatomical structure known as the Anthelix on the lateral side of the ear is a ridge which is located directly opposite the outer edge of the ear, the ear ridge known as the Helix, and which is separated therefrom by a groove (Scapha). The Anthelix surrounds the ear cavity (Concha auriculae), which leads via the auditory canal inlet funnel (Cavum conchae) to the outer auditory canal. The second transition segment (44) of the holding device (1) is braced with its part facing toward the end piece (2) along the Anthelix in the Concha in such a way that the latter is largely completely framed. During use, the terminally arranged holder (3) comes to lie in the outer auditory canal of the user. According to the invention, a holder will be understood to mean a component which is suitable for accommodating other components, for example optical, electronic or micromechanical components. Due to the flexible design of the connecting element, bracing is advantageously possible in both ears, so that the holding device can be worn both on the right ear and on the left ear of a user and is optimally protected against slipping. These advantages are obtained in particular when the holding device is worn for a relatively long period of time (for example overnight) and/or when the holding device is subjected to external influences such as, for example, acceleration or deceleration of the head.

In one advantageous development of the holding device (1) according to the invention, the ratio of r1 to r2 may be such that r1>r2. A radius r1 larger than r2 may advantageously optimize the bearing of the end piece (2) and of the support hook (41) in the fossa anthelicis in that this part of the connecting element (4) comes to lie therein along a portion of its length that is as long as possible. At the same time, the transition of the holding device to the lateral side of the auricle is improved in that the first transition segment (43) is guided all the way around the projection of the Helix and does not bear against the latter, so that the straight middle piece (42) adjoining the first transition segment (43) comes to lie largely parallel to the lower leg of the Anthelix (Crus inferius anthelicis). An optimized bracing of the second transition segment (44) along the Anthelix in the Concha is thus ensured.

In another advantageous embodiment of the holding device (1) according to the invention, the ratio of r1 to r2 may lie in the range from 1.1 to 3. A holding device (1) in which the ratio of r1 to r2 lies in a range from 1.1 to 1.5 may preferably be suitable for users whose Concha (ear cavity, see above) is large in relation to the total length and total width of the ear. Here, the total length of the ear is measured from the highest point of the Helix (supraaural) to the lowest point of the earlobe (subaural), and the total width of the ear is measured from the Tragus to the Helix. A Concha that is large in relation to the total length and total width of the ear is found especially on children. By selecting suitable radii ratios, the holding device can be optimally adapted to children's ears.

In another implementation of the holding device (1) according to the invention, the connecting element (4) in the region of the first transition segment (43) and the adjoining part of the support hook (41) is designed in the form of a hollow cylinder having a largely elliptical cross-sectional area, and the connecting element (4) in the region of the middle piece (42) and the second transition segment (44) is designed in the form of a hollow cylinder having a largely circular cross-sectional area. The connecting element (4) thus designed enables optimal adaptation to the anatomical structures of the ear and head, between and along which it extends when in use. Particularly when the device is worn for a relatively long period of time (for example overnight) and when pressure is exerted on the ear from lateral to medial (when the ear wearing the device is bearing against a support, for example while sleeping), the pressure on the ear that is caused by the inserted holding device can be substantially reduced.

In one particularly preferred embodiment of the connecting element (4) of the holding device (1), the main axis of the elliptical cross-sectional area may in each case extend largely perpendicular to the ear-side bearing surface of the connecting element (4). Due to the advantageous orientation of the connecting element (4) in the region of the support hook and the first transition segment (43) in the fossa anthelicis, the pressure acting on the auricle and on the medially adjacent temporal region of the head when the device is worn for a relatively long period of time (for example overnight) is distributed over a relatively large area. This is particularly advantageous when a pressure acts on the ear from lateral to medial (when the ear wearing the device is bearing against a support, for example while sleeping); the occurrence of pressure points can largely be avoided.

In one advantageous development of the holding device (1) according to the invention, n (n=1, 2 . . . ) further transition segments (45) may be arranged between the second transition segment (44) and the holder (3). In principle, transition segments may also be arranged elsewhere, for example at the transition between the first transition segment (43) and the middle piece (42) or at the transition between the support hook (41) and the first transition segment (43). Preference is given to arranging one or more further transition segments in the region of the terminal holder (3). The flexible connecting element (4) can thus easily be extended and can take account of the individual anatomical conditions of the user, for example a relatively large Concha.

In another implementation, a connecting element extension (46) may be detachably attached to the middle piece (42) and to the second transition segment (44). The connecting element extension (46) is preferably designed as an elongated, largely C-shaped, pre-bent body which is to be attached to the connecting element (4) by a force-fitting connection, for example a clamping connection. The connecting element extension (46) preferably has a lower degree of flexibility than the connecting element (4); for example, the modulus of elasticity E of the connecting element extension (46) is greater than the modulus of elasticity of the connecting element (4). By means of the connecting element extension (46), a holding device can easily be extended in the region of the part of the connecting element (4) that bears against the Anthelix, so that a holding device having a small r2 can be adapted to a Concha requiring a larger r2. The connecting element extension (46) may alternatively be designed as a cylinder segment, which is attached to the middle piece (42) and the second transition segment (43) of the connecting element (4) in such a way that a free space (and thus the ear cavity) located between the second transition segment (43) and the edge of the Anthelix is filled. This type of connecting element extension (46) is preferably designed as a suitably dimensioned half-cylinder.

In one preferred embodiment, the material of the holding device (1) may comprise a thermoplastic elastomer having a Shore A hardness in the range from 40 to 70. Preferably, the holding device (1) may be made of a thermoplastic elastomer having a Shore A hardness in the range from 45 to 65. Particularly preferably, the Shore A hardness may lie in the range from 50 to 60. The Shore hardness is a measure of the material hardness (defined in DIN EN ISO 868 and DIN ISO 7619-1). It is mainly used to characterize elastomers and rubber-elastic polymers and is directly related to the depth of penetration of an indenter (a spring-loaded pin made of hardened steel) into the test specimen in question. The depth of penetration is a measure of the Shore hardness, which is measured on a scale from 0 Shore (2.5 millimeter depth of penetration) to 100 Shore (0 millimeter depth of penetration). Thermoplastic elastomers (TPEs) are known from the prior art. TPEs are approved for use in medicine (defined in the biocompatibility standard DIN EN ISO 10993). Preferably, the holding device (1) is made of a thermoplastic polyolefin, of a thermoplastic polyethylene ester, of a thermoplastic polyurethane, or of a thermoplastic polyether amide. Alternatively, the holding device may be made of a silicone suitable for medical purposes.

In one preferred implementation, the holding device (1) is plastically deformable. In the context of this disclosure, plastically deformable will be understood to mean the ability to deform irreversibly, and without resetting force, under the effect of force after exceeding a flow limit, and to maintain this shape thereafter. Below the flow limit, no deformation or only elastic deformation occurs.

In another preferred embodiment, the holding device (1) may be designed with a soft-touch surface. A soft-touch surface will be understood to mean a surface which is characterized by a soft surface feel. The soft-touch surface advantageously increases the roughness of the surface. The holding device may advantageously have a mean surface roughness (Ra) of approximately 400 to approximately 800 nm. The parameter of the mean surface roughness Ra is known from the prior art; it indicates the mean distance from a measurement point—on the surface—to the center line. The center line intersects the real profile within the reference distance so that the sum of the profile deviations (relative to the center line) becomes minimal. As the Ra value increases, the surface roughness becomes greater. During use, the roughened surface advantageously improves in particular the grip of the portions of the holding device (1) arranged in the fossa anthelicis, namely the end piece (2), the housing (22) and the first transition segment (43). Furthermore, the grip of the part of the holding device (1) placed in the Concha is also improved. In addition, the wearing comfort of the holding device (1) is improved.

In another implementation of the holding device (1) according to the invention, an electrical connection element (7), which extends in the tubular interior space (6) of the connecting element (4), and a reinforcement fiber (8) have a combined tensile strength in the range from 50 and 70N under load. The tensile strength ("pull strength" or "pull tension") for connection elements refers to the strength under load without any damage occurring to the connection element and without changing the characteristic properties thereof. For the connection element (7) according to the invention and the reinforcement fiber (8) according to the invention, the tensile strength is determined under a load of 5.9 kg (13 lbs). Electrical connection elements are known from the prior art. According to the invention, one or more electrical connection elements may be arranged in the tubular interior space (6) of the connecting element (4). These may be designed for example as cables (single-core or multi-core assembly of individual wires, which serves to transmit energy or information) or as a flexible printed circuit board. A printed circuit board will be understood to mean a support for electronic components, which is made of an electrically insulating material with conductive connections (conductor tracks) adhering thereto. In the case of a flexible printed circuit board, the support is made of a flexible material, for example a polymer film made of polyimide. Flexible printed circuit boards can be inserted in narrow spatial structures in a particularly space-saving manner by folding. Preferably, the reinforcement fiber may be connected to components accommodated in the housing (22) and in the terminal holder (3). The reinforcement fiber (8) may preferably be wound around the one or more electrical connection elements (8). The holding device designed with a reinforcement fiber (8) is characterized by an increased stability when subjected to tensile stress. The high tensile strength enables safe insertion and removal of the holding device according to the invention. It also enables the holding device according to the invention to be used in fields of application which have special safety requirements, for example use by children, and also in the medical sector, in particular in pediatrics and (pediatric) intensive care.

In another implementation of the holding device (1) according to the invention, the end piece (2), the holder (3) and the connecting element (4) may be integrally formed. An integral design of the holding device advantageously enables easy manufacture since no connections of the individual components via separate connection pieces are required. Since the individual portions of the holding device merge into one another, the integral holding device is characterized by easy handling during cleaning and use.

In one advantageous development, the holding device (1) may have openings (221, 31) in the region of the housing (22) and the holder (3), which openings fluidically connect the interior space (6) to the exterior (61) surrounding the holding device (1). For example, the openings can easily enable the interaction of components mounted in the holder (3) and in the housing (22) with structures of the exterior, such as for example the auditory canal, or with receiver modules, charging modules, etc.

In another embodiment of the holding device (1) according to the invention, the holder (3) may be designed to hold one or more microelectromechanical systems and/or microoptoelectromechanical systems and/or sensor systems. With particular preference, the holder (3) may be designed to hold one or more temperature sensors (51), one or more acceleration sensors (52) or inertial sensors, including gyroscopes and/or compass sensors, and/or to hold optical sensors.

In a second aspect, the invention relates to a box (9) for holding the holding device (1) described above. The box (9) is arranged with a mount (10) which has a recess (11) complementary to the holding device (1). The recess (11) comprises an end piece recess (112), a housing recess (1122), a connecting element recess (114) and a holder recess (113). The holding device (1) according to the invention can be stored in the associated box (9) in a shape-stable manner when not in use. Since the holding device (1) is largely S-shaped and flexible in the region of the connecting element (4), improper storage may cause deformation and/or twisting of the connecting element (4) in particular, so that the second transition segment (44) of the holding device (1) can no longer be braced along the Anthelix in the Concha with its part facing toward the end piece (2). Although the terminally arranged holder (3) of a holding device (1) deformed by pressure or tensile stress can come to lie in the outer auditory canal of the user during use, the second transition segment (44) may twist outward from the Concha such that the latter is no longer largely completely framed by the second transition segment (44).

In one advantageous development of the box (9) according to the invention, the housing recess (1122) may comprise a first contact element (12) such that the first contact element (12) during use comes to lie directly adjacent to a complementarily shaped housing contact element (221) of the holding device (1). The complementarily shaped contact elements are preferably galvanic contacts. These serve to charge an accumulator (53) which is held in the housing (22) of the holding device (1) and which is connected to the housing contact element (221). Preferably, the housing contact element (221) of the holding device (1) may be provided with a protective flap, which ensure that the charging contacts do not come into contact with the skin of the user when being worn. The first contact element (12) included in the housing recess (1122) serves for connection to a power source that is connected to the box (9). An accumulator of the holding device (1) stored in a shape-stable manner in the box (9), which comprises powered electrical components, can thus easily be charged.

In another embodiment of the box (9) according to the invention, the holder recess (113) may comprise a second contact element (13) such that the second contact element (13) during use comes to lie directly adjacent to the holder (3) of the holding device (1). Preferably, by means of the second contact element of the box (9), sensor elements mounted in the holder (3) can be calibrated prior to use or otherwise prepared for use in the outer auditory canal of the user.

In one particularly preferred embodiment, the second contact element (13) may be designed as a heating element (14). A holder (3) accommodating a temperature sensor may be heated to a defined temperature value prior to use of the holding device (1) so as to be able to measure a meaningful temperature value within a very short time following insertion into the outer auditory canal of a user. This pretreatment of the holding device (1) thus designed can significantly shorten the time between the attachment of the holding device (1) to the ear of the user and the detection of an accurate temperature in the outer auditory canal of the user, compared to other devices which detect the temperature in the outer auditory canal.

BRIEF DESCRIPTION OF THE FIGURES

A few particular embodiments of the invention will be described below, by way of example and non-exhaustively, with reference to the accompanying figures.

The particular embodiments serve only to explain the general inventive concept, but they do not limit the invention.

PREFERRED IMPLEMENTATION OF THE INVENTION

Figure 1A:
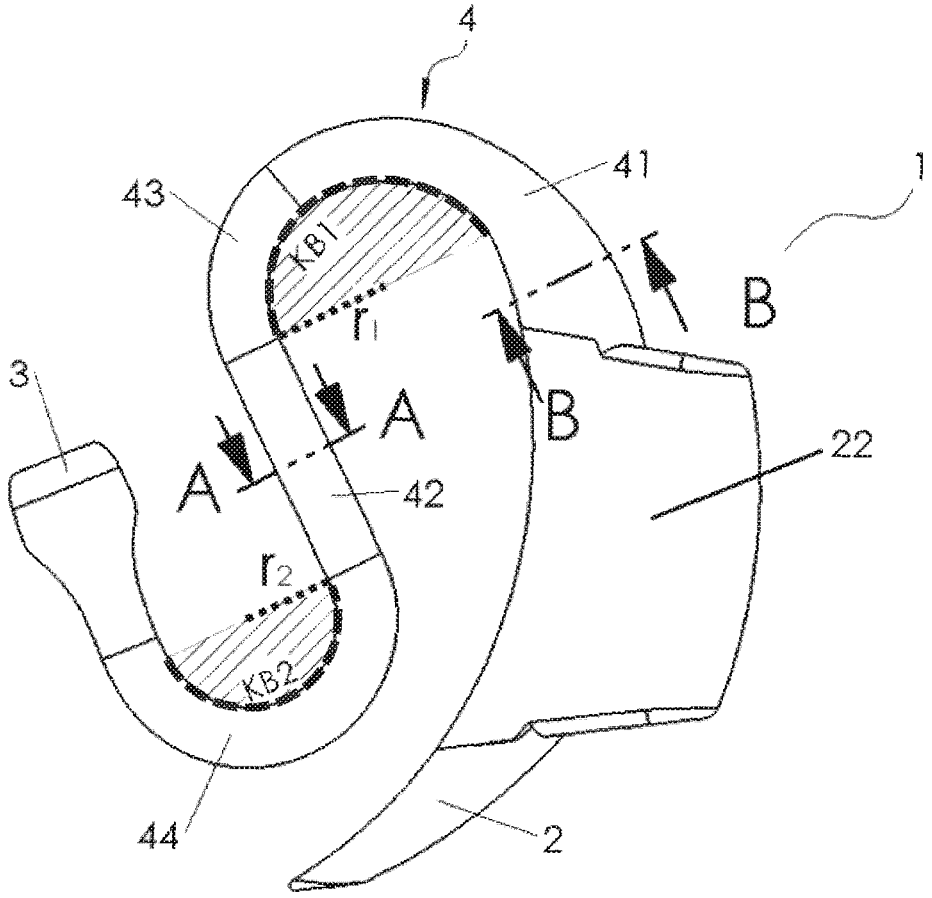
FIG. 1A shows a schematic view of the holding device (1) according to the invention from the side, illustrating the geometric structures for explanation purposes.

FIG. 1A shows a schematic side view of the holding device (1) according to the invention for attachment to the ear of a user. The holding device (1) comprises an end piece (2), which is designed with a housing (22) to be worn behind an ear of a user, and a terminally arranged holder (3). A substantially S-shaped, flexible connecting element (4) is arranged between the end piece (2) and the holder (3), said connecting element comprising a support hook (41) adjacent to the end piece (2), a middle piece (42), a first transition segment (43), and a second transition segment (44) adjacent to the holder (3). The first transition segment (43) is arranged between the support hook (41) and the middle piece (42), and the second transition segment (44) is arranged between the middle piece (4) and the holder (3). The terminally arranged holder (3) is designed with a larger diameter than the connecting element (4), so that it can be introduced into the outer auditory canal of a user and largely fills the latter. The outer auditory canal is preferably closed by the holder (3). If necessary, a holder add-on (not shown) can be arranged on the holder (3) in order to close the auditory canal during use of the holding device (1); by way of example, the use of a holder add-on may be required in the case of an auditory canal of large diameter. The connecting element (4) forms a first circular arc (KB1, thick dashed line) in the region of the support hook (41) and the first transition segment (43). A second circular arc (KB2, thick dashed line) is formed in the region of the second transition segment (44), wherein the first circular arc (KB1) of radius r1 (r1 shown, thin dashed line) bounds a first circular sector (KS1, hatched), and the second circular arc (KB2) of radius r2 (r2 shown, thin dashed line) bounds a second circular sector (KS2, hatched). When worn, the support hook (41) and the first transition segment (43) come to lie in the fossa anthelicis located on the rear side of the ear between the auricle and the head. The holding device (1) is additionally braced on the lateral side of the ear in the Concha (ear cavity) along the Anthelix by means of the second transition segment (44).

Figure 1B:
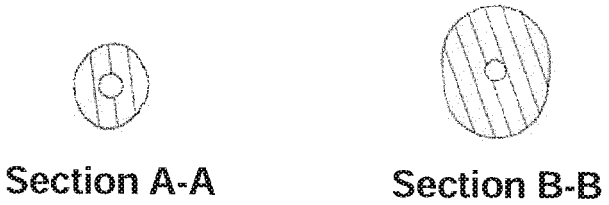
FIG. 1B shows the cross-sectional areas of the holding device along the section lines A-A and B-B.

In the region of the middle piece (42) and the second transition segment (44), the connecting element (4) is designed in the form of a hollow cylinder having a largely circular cross-sectional area (section line A-A, FIG. 1B, left). In addition, in the region of the first transition segment (43) and the adjoining part of the support hook (41), the connecting element (4) is designed in the form of a hollow cylinder having a largely elliptical cross-sectional area (section line B-B, FIG. 1B, right). In particular, the main axis (H, dashed; the secondary axis, which extends perpendicular to the main axis H, is also shown) of said elliptical cross-sectional area extends in each case largely perpendicular to the ear-side bearing surface of the connecting element (4). The connecting element (4) thus designed enables optimal adaptation to the anatomical structures of the ear and head, between and along which it extends when in use. Due to the advantageous orientation of the connecting element (4) in the region of the support hook and the first transition segment (43) in the fossa anthelicis, the pressure acting on the auricle and on the medially adjacent head when the device is worn for a relatively long period of time (for example overnight, with the ear wearing the device bearing against a support) is distributed over a relatively large area. The occurrence of pressure points can thus be avoided.

Figure 2A:
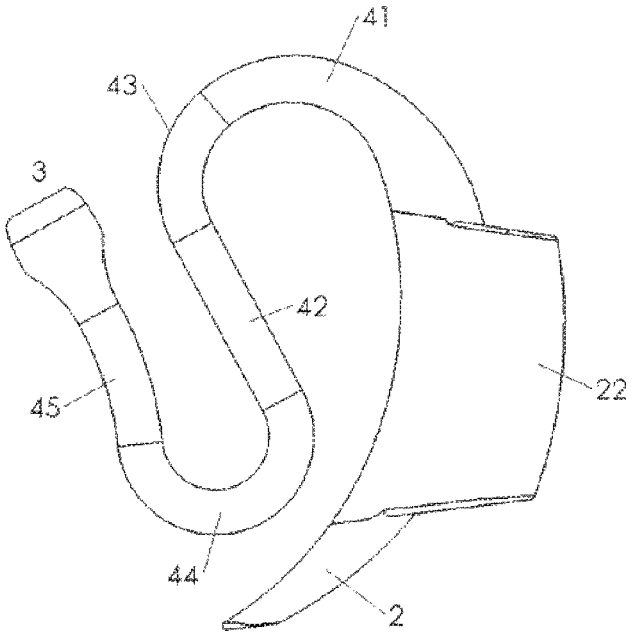
FIG. 2A shows another embodiment of the holding device (1) according to the invention from the side.
Figure 2B:
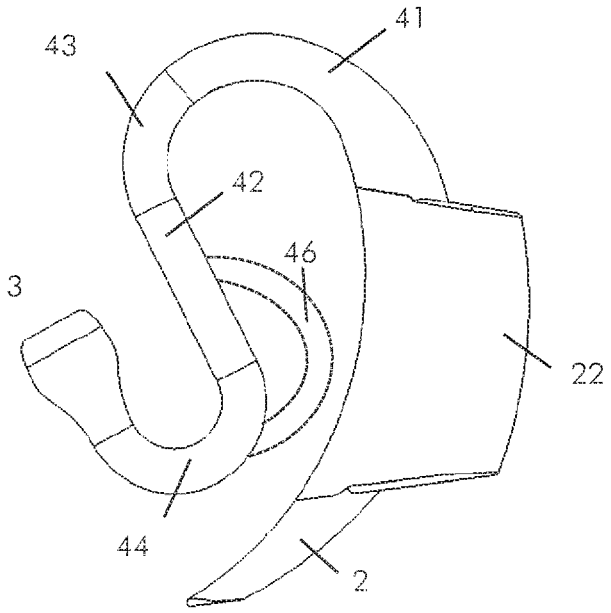
FIG. 2B shows an embodiment of the holding device (1) according to the invention with an extension element.

FIGS. 2A and 2B show another embodiment of the holding device (1) according to the invention from the side. In the first development (FIG. 2A), one further transition segment (45) is arranged between the second transition segment (44) and the holder (3). In FIG. 2B, an elongated, largely C-shaped, pre-bent connecting element extension (46) is detachably attached to the middle piece (42) and to the second transition segment (44). By means of the one transition segment (45) and/or a connecting element extension (46), a holding device can easily be extended in the region of the part of the connecting element (4) that bears against the Anthelix, so that a holding device having a small r2 can be adapted to a Concha requiring a larger r2.

Figure 3:
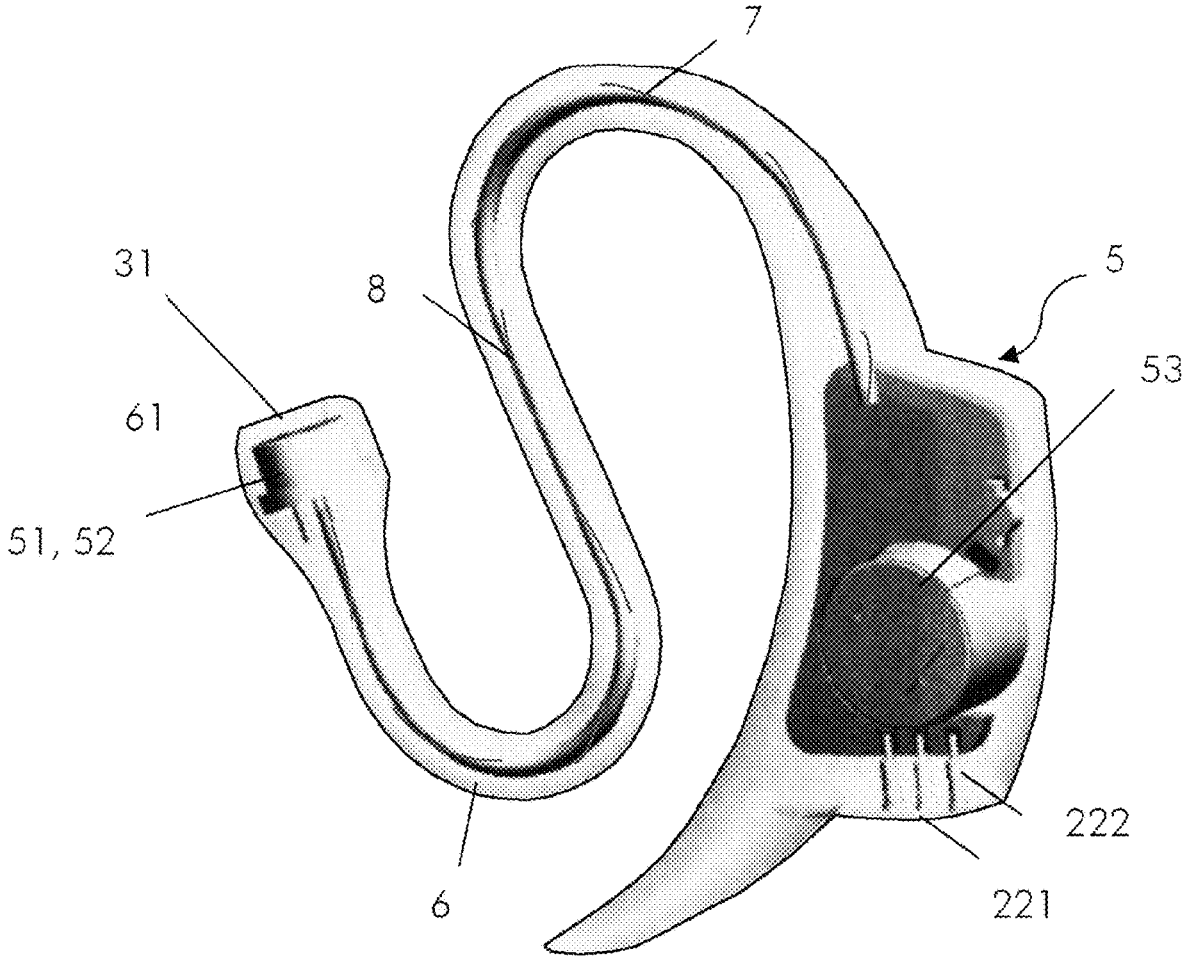
FIG. 3 shows a schematic view of the interior space (6) of the holding device (1) according to the invention and of the components arranged in the interior space (6).

FIG. 3 shows a schematic view of the interior space (6) of the holding device (1) according to the invention and of the components arranged in the interior space (6). The holding device is designed with an interior space (6) for holding various components (5), for example electronic, micromechanical, microoptomechanical or optical components. Preferred components which come to lie in the holder (3) are a temperature sensor (51) and/or an acceleration sensor (52). The holding device (1) is largely tubular in the region of the connecting element (4) (see cross-sections in FIG. 1B). The interior space (6) may be omitted in the terminal part of the end piece (2). In the region of the housing (22) and the holder (3), the holding device (1) has openings (221, 31) which fluidically connect the interior space (6) to the exterior (61) surrounding the holding device (1). For example, the openings can easily enable the interaction of components mounted in the holder (3) and in the housing (22) with structures of the exterior, such as for example the auditory canal, or with receiver modules, charging modules, etc. A reinforcement fiber (8) is wound around the electrical connection element (7), thereby optimizing the load under tension of the holding device (1). This enables the holding device (1) according to the invention to be used in fields of application which have special safety requirements.

Figure 4A:
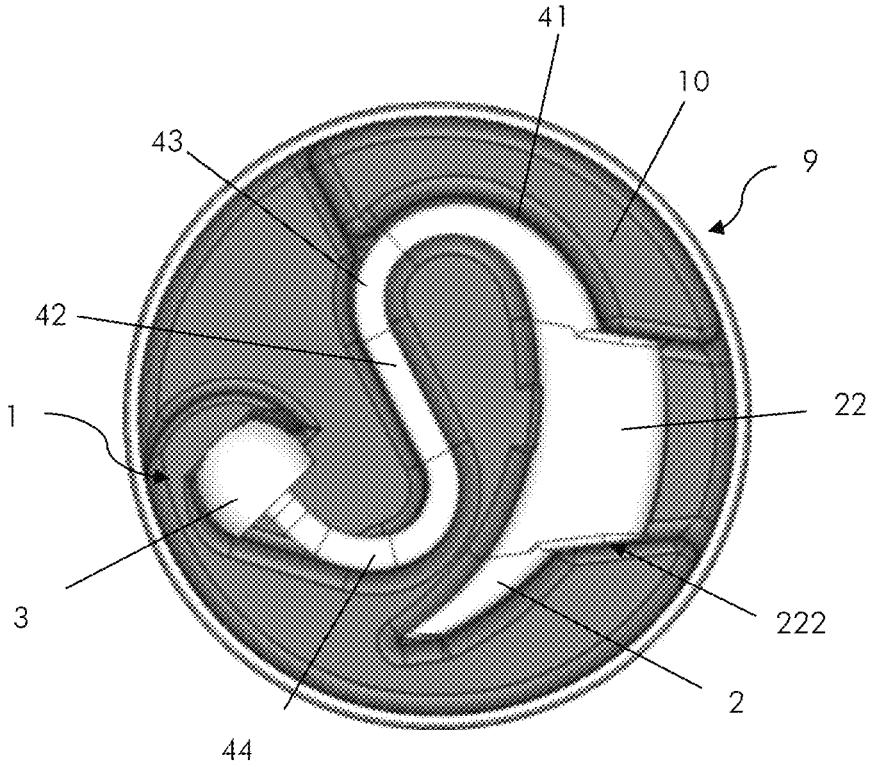
FIG. 4A shows a schematic diagram of the holding device (1) stored in the box (9)
Figure 4B:
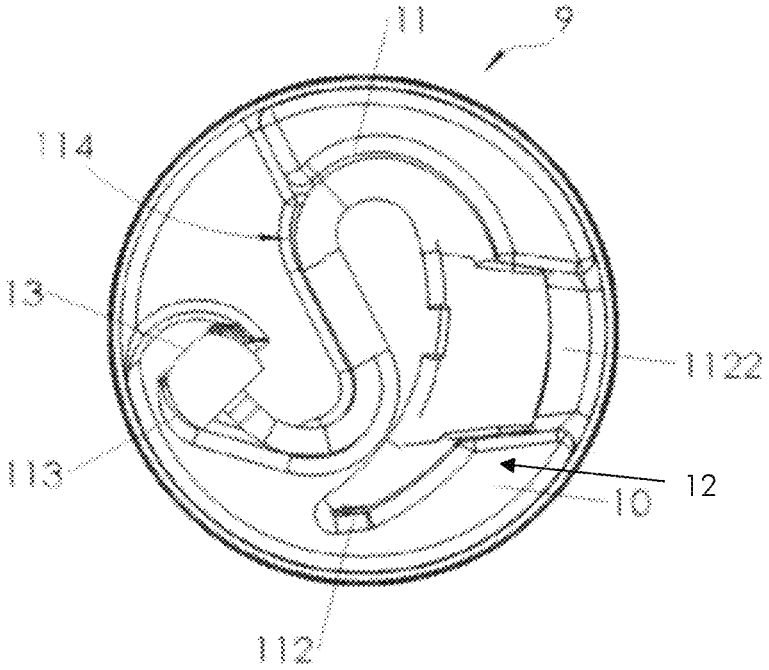
FIG. 4B shows the box (9), in which parts of the holding device (1) are removed for a clearer understanding.

FIG. 4A is a schematic diagram of the holding device (1) stored in the box (9) according to the invention; FIG. 4B shows the box (9), in which parts of the holding device (1) are removed for a clearer understanding. The box (9) has a mount (10) arranged, which has a recess (11) complementary to the holding device (1) (FIG. 4B). The recess (11) comprises an end piece recess (112), a housing recess (1122), a connecting element recess (114) and a holder recess (113). The box (9) serves for storing the holding device (1) according to the invention in a shape-stable manner can in the associated box (9) when not in use. Improper storage of the flexible holding device, in particular of the S-shaped connecting element (4), may cause deformation and/or twisting, so that the second transition segment (44) can no longer be braced along the Anthelix in the Concha with its part facing toward the end piece (2). The housing recess (1122) comprises a first contact element (12), which during use is located in the direct vicinity of the complementarily shaped housing contact element (222) of the holding device (1). These complementary contact elements are preferably galvanic contacts and serve for charging the accumulator (53, FIG. 3) which is held in the housing (22) of the holding device (1) and which is connected to the housing contact element (222). The first contact element (12) included in the housing recess (1122) serves for connection to a power source (not shown) that is connected to the box (9). Arranged in the holder recess (113) is a second contact element (13), which during use comes to lie directly adjacent to the holder (3) of the holding device (1). By means of the second contact element (13) of the box (9), sensor elements mounted in the holder (3) for example can be calibrated prior to use or otherwise prepared for use in the outer auditory canal of the user. The second contact element (13) may preferably be designed as a heating element and may heat a temperature sensor in the holder (3) to a defined temperature value prior to use of the holding device (1).

LIST OF REFERENCE SIGNS

1 holding device
2 end piece
22 housing
221 housing opening
222 housing contact element
3 terminally arranged holder
31 holder opening
4 connecting element
41 support hook
42 middle piece
43 first transition segment
44 second transition segment
45 further transition segment
46 connecting element extension
5 component
51 temperature sensor
52 inertial sensor
53 accumulator
6 interior space of the holding device
7 electrical connection element
8 reinforcement fiber
9 box
10 mount
11 recess of the mount
112 end piece recess
1122 housing recess
113 holder recess
114 connecting element recess
12 first contact element
13 second contact element

The invention claimed is:

1. A holding device (1) for attachment to the ear of a user, comprising:

an end piece (2), wherein the end piece (2) is designed with a housing (22) to be worn behind an ear of a user, a terminally arranged holder (3), a substantially S-shaped, flexible connecting element (4) arranged between the end piece (2) and the holder (3), said connecting element comprising a support hook (41) adjacent to the end piece (2), a middle piece (42), a first transition segment (43), and a second transition segment (44) adjacent to the holder (3), wherein the first transition segment (43) is arranged between the support hook (41) and the middle piece (42), and the second transition segment (44) is arranged between the middle piece (4) and the holder (3), wherein the holding device is designed with an interior space (6) for accommodating components (5), and wherein the holding device (1) is largely tubular in the region of the connecting element (4), characterized in that the connecting element (4) forms a first circular arc (KB1) in the region of the support hook (41) and the first transition segment (43) and forms a second circular arc (KB2) in the region of the second transition segment (44), wherein the first circular arc (KB1) of radius r1 bounds a first circular sector (KS1) and the second circular arc (KB2) of radius r2 bounds a second circular sector (KS2), wherein r1≥r2, and wherein the connecting element (4) in the region of the first transition segment (43) and the adjoining part of the support hook (41) is designed in the form of a hollow cylinder having a largely elliptical cross-sectional area and, and the connecting element (4) in the region of the middle piece (42) and the second transition segment (44) is designed in the form of a hollow cylinder having a largely circular cross-sectional area.

2. The holding device (1) according to claim 1, wherein r1>r2.

3. The holding device (1) according to claim 2, wherein the ratio of r1 to r2 lies in the range from 1.1 to 3.

4. The holding device (1) according to claim 1, wherein the main axis of the elliptical cross-sectional area extends in each case largely perpendicular to the ear-side bearing surface of the connecting element (4).

5. The holding device (1) according to claim 1, wherein n (n=1, 2 . . . ) further transition segments (45) are arranged between the second transition segment (44) and the holder (3).

6. The holding device (1) according to claim 1, wherein a connecting element extension (46) is detachably attached to the middle piece (42) and to the second transition segment (44).

7. The holding device (1) according to claim 1, wherein the holding device (1) is made of a thermoplastic elastomer having a Shore A hardness in the range from 40 to 70.

8. The holding device (1) according to claim 1, wherein the holding device (1) is plastically deformable.

9. The holding device (1) according to claim 1, wherein an electrical connection element (7), which extends in the tubular interior space (6) of the connecting element (4), and a reinforcement fiber (8) have a combined tensile strength in the range from 50 N to 70 N under load.

10. The holding device (1) according to claim 1, wherein the end piece (2), the holder (3) and the connecting element (4) are integrally formed.

11. The holding device (1) according to claim 1, wherein the holding device (1) has openings (221, 31) in the region of the housing (22) and the holder (3), which openings fluidically connect the interior space (6) to the exterior (61) surrounding the holding device (1).

12. The holding device (1) according to claim 1, wherein the holder (3) is designed to hold one or more microelectromechanical systems and/or microoptoelectromechanical systems and/or sensor systems.

13. A box (9) for holding a holding device (1) for attachment to the ear of a user, the holding device (1) comprising an end piece (2), wherein the end piece (2) is designed with a housing (22) to be worn behind an ear of a user; a terminally arranged holder (3); a substantially S-shaped, flexible connecting element (4) arranged between the end piece (2) and the holder (3), said connecting element comprising a support hook (41) adjacent to the end piece (2), a middle piece (42), a first transition segment (43), and a second transition segment (44) adjacent to the holder (3), wherein the first transition segment (43) is arranged between the support hook (41) and the middle piece (42), and the second transition segment (44) is arranged between the middle piece (4) and the holder (3); wherein the holding device is designed with an interior space (6) for accommodating components (5); and wherein the holding device (1) is largely tubular in the region of the connecting element (4); characterized in that the connecting element (4) forms a first circular arc (KB1) in the region of the support hook (41) and the first transition segment (43) and forms a second circular arc (KB2) in the region of the second transition segment (44), wherein the first circular arc (KB1) of radius r1 bounds a first circular sector (KS1) and the second circular arc (KB2) of radius r2 bounds a second circular sector (KS2); wherein r1≥r2, wherein the box (9) is arranged with a mount (10) which has a recess (11) complementary to the holding device (1), wherein the recess (11) comprises an end piece recess (112), a housing recess (1122), a connecting element recess (114) and a holder recess (113).

14. The box (9) according to claim 13, wherein the housing recess (1122) comprises a first contact element (12) such that the first contact element (12) during use comes to lie directly adjacent to a complementarily shaped housing contact element (221) of the holding device (1).

15. The box (9) according to claim 13, wherein the holder recess (113) comprises a second contact element (13) such that the second contact element (13) during use comes to lie directly adjacent to the holder (3) of the holding device (1).

16. The box (9) according to claim 15, wherein the second contact element (13) is designed as a heating element.

* * * * *